US009970135B2

(12) United States Patent
A.

(10) Patent No.: US 9,970,135 B2
(45) Date of Patent: May 15, 2018

(54) KNITTING SPOOL

(71) Applicant: Devagnanam T. A., Tamil Nadu (IN)

(72) Inventor: Devagnanam T. A., Tamil Nadu (IN)

( * ) Notice: Subject to any disclaimer, the term of this patent is extended or adjusted under 35 U.S.C. 154(b) by 0 days. days.

(21) Appl. No.: 15/324,187

(22) PCT Filed: Jul. 7, 2015

(86) PCT No.: PCT/IN2015/050062
§ 371 (c)(1),
(2) Date: Jan. 5, 2017

(87) PCT Pub. No.: WO2016/006001
PCT Pub. Date: Jan. 14, 2016

(65) Prior Publication Data

US 2017/0175311 A1 Jun. 22, 2017

(30) Foreign Application Priority Data

Jul. 8, 2014 (IN) ..... 3373/CHE/2014

(51) Int. Cl.
*D04B 3/00* (2006.01)
*D04B 5/00* (2006.01)

(52) U.S. Cl.
CPC ..... *D04B 3/00* (2013.01); *D04B 5/00* (2013.01)

(58) Field of Classification Search
CPC ..... D04B 3/00; D04B 5/00
USPC ..... 66/3, 4, 1 A
See application file for complete search history.

(56) References Cited

U.S. PATENT DOCUMENTS

| | | | | | |
|---|---|---|---|---|---|
| 1,318,604 | A * | 10/1919 | Schneider | D04B 39/00 | 66/4 |
| 1,500,383 | A | 7/1924 | Gourie | | |
| 2,072,668 | A * | 3/1937 | Eltgroth | D04B 17/00 | 66/4 |
| 2,687,630 | A * | 8/1954 | Carlson | D04B 3/00 | 66/117 |
| 3,967,467 | A * | 7/1976 | Leach, Sr. | D04B 3/00 | 66/4 |
| 4,193,273 | A * | 3/1980 | Palange | D04B 39/00 | 66/4 |
| 7,506,524 | B2 * | 3/2009 | Gustin | D04B 3/00 | 66/1 A |
| D676,069 | S * | 2/2013 | Fujiwara | D15/78 | |
| 8,402,794 | B2 * | 3/2013 | Sasur | D04B 5/00 | 66/3 |
| 8,596,096 | B1 | 12/2013 | Russell et al. | | |
| 9,234,306 | B1 * | 1/2016 | Chang | D04B 3/00 | |
| 2008/0156043 | A1 * | 7/2008 | Gustin | D04B 3/00 | 66/4 |
| 2011/0259465 | A1 | 10/2011 | Schaub | | |
| 2012/0047960 | A1 * | 3/2012 | Sasur | D04B 3/00 | 66/1 A |

* cited by examiner

*Primary Examiner* — Danny Worrell
(74) *Attorney, Agent, or Firm* — Eversheds Sutherland (US) LLP

(57) ABSTRACT

A knitting spool for knitting comprising a tubular body having a through hole; a plurality of yarn retention members mounted at an end face of the tubular body; wherein the tubular body is formed of two parts detachable along a plane parallel to the longitudinal axis of the tubular body.

14 Claims, 2 Drawing Sheets

KNITTING SPOOL

FIELD OF THE INVENTION

The present invention relates to a knitting device. In particular, the present invention relates to an improved knitting spool.

BACKGROUND OF THE INVENTION

Spool knitting or French knitting is a form of knitting that uses a spool with a number of pegs and a chrochet needle/loom hook to knit a tube from yarn. Many articles can be made from the resulting tube. For example, the tube can be wound in a spiral to produce mat, rug, etc. If a larger spool with more nails is used, a sock or a hat could be knitted.

In the past different techniques and tools of spool knitting have been used. A typical knitting spool has a tubular body with a through hole and number of yarn engaging members fixed on one end face of the spool. The yarn engaging members extend out from the end face of the spool. The spool is adapted to be easily held by one hand. A length of yarn is looped around a post using a loom hook or a chrochet needle or the like, etc. Yarn is, in turn, looped over each post to knit the yarn. There are several known knitting techniques to knit a tube. The number and shape of the yarn engaging members fixed on the spool may also vary for different techniques. During the knitting operation, knitted portion of the tube comes out from the hole in the tubular body at the end which is opposite to fixed yarn engaging members.

The knitting spool can also be used to knit a tube around an article. However, the article has to be placed in the hole of the spool to knit a tube around the article before starting the knitting operation. If the article has attachments at the end which cannot be inserted in the hole of the knitting spool, then a tube cannot be knit around the article. Therefore, there is a need for a knitting spool which can knit tube around an article with end attachments bigger than the hole of the knitting spool.

Also, different knitting techniques require different number of yarn engaging member on the knitting spool. Shape of the yarn engaging members is also different with different techniques and yarn properties. Therefore, separate knitting spools are required for different yarns and techniques. This can become cumbersome, especially if different articles are needed to be knitted by the same knitting spool. Thus, there remains a pressing need, where a single spool knitter can be used to knit articles of different shape and sizes.

OBJECTS OF THE INVENTION

It is an object of the invention to provide an improved knitting spool for knitting a tube around an article which has end attachments bigger than hole of the knitting spool.

Another object of the invention is to provide a knitting spool wherein number and shape of pegs on the spool may be varied.

Yet another object of the invention is to provide a knitting spool wherein it is possible to identify the starting point during knitting.

SUMMARY OF THE INVENTION

According to the present invention an improved knitting spool for knitting tubular articles is provided comprising a tubular body having a through hole; and a plurality of yarn retention members mounted at an end face of the tubular body; wherein the tubular body is formed of two parts detachable along a plane parallel to the longitudinal axis of the tubular body.

According to a preferred embodiment of the present invention, the tubular body is divided into two equal halves by a plane parallel to the longitudinal axis of the tubular body.

According to another preferred embodiment of the present invention, the detachable parts are arranged together by interlocking pin arrangement.

According to another preferred embodiment of the present invention, the detachable parts are held together by rubber rings.

According to another preferred embodiment of the present invention, the detachable body has grooves on the outside surface for accommodating said rubber rings.

According to another preferred embodiment of the present invention, the yarn retention members are pegs.

According to another preferred embodiment of the present invention, the pegs have a head at free end.

According to another preferred embodiment of the present invention, the yarn retention members are U-pins.

According to another preferred embodiment of the present invention, the U-pins are inclined outwards from the spool axis at free end.

According to another preferred embodiment of the present invention, each u-pin is mounted in an inverted position on the face of the tubular body.

According to another preferred embodiment of the present invention, the pegs and U-pins are detachable from the tubular body.

According to another preferred embodiment of the present invention, the number of pegs arranged on an end face the tubular body is four, six, eight or twelve.

According to another preferred embodiment of the present invention, the number of U-pins arranged on an end face the tubular body is two, four or six.

According to another preferred embodiment of the present invention, one peg has different shape than that of the other pegs to identify the starting point during knitting.

BRIEF DESCRIPTION OF THE DRAWINGS

The accompanying drawings constitute a part of the description and are used to provide further understanding of the present invention. Such accompanying drawings illustrate the embodiments of the present invention which are used to describe the principles of the present invention together with the description.

DETAILED DESCRIPTION OF THE INVENTION

Figures 1, 2, 3, 4:
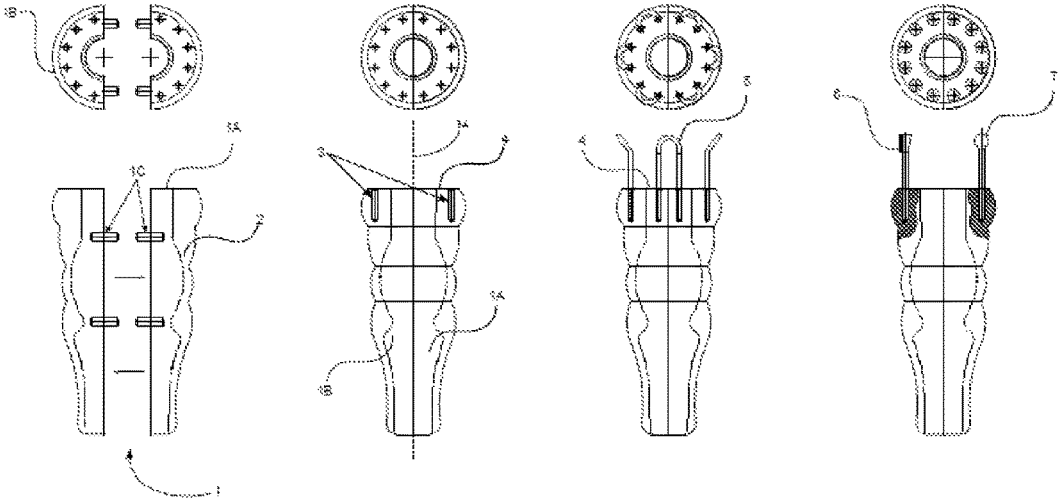
FIG. 1 illustrates top and side view of the un-assembled parts of knitting spool according to one embodiment of the present invention.
FIG. 2 illustrates top and side view of the assembled parts of knitting spool according to one embodiment of the present invention.
FIG. 3 illustrates top and side view of the assembled knitting spool with U-pins according to one embodiment of the present invention.
FIG. 4 illustrates top and side view of the assembled knitting spool with pegs according to one embodiment of the present invention.

FIG. 1 illustrates top and side views of the knitting spool according to one embodiment of the present invention. The knitting spool is formed from two parts which are detachable along a plane parallel to a longitudinal axis of the knitting spool (1). The shape of the detachable parts is such that a through hole is formed when the two parts are assembled together. According to one embodiment of the invention, the knitting spool (1) may be formed from two parts which are identical in shape and size. In such a scenario, the two parts (1A) and (1B) of the knitting spool (1) are detachable along a plane parallel to central axis (3A) of the knitting spool (1). A groove running along the entire length of the face (1C) of each of the two detachable parts (1A) and (1B) forms a through hole in the assembled knitting spool (1).

Interlocking pins (2) and pin holes are provided on the faces of the two detachable parts (1A) and (1B) of the knitting spool (1). During the assembly of the two detachable parts (1A) and (1B), the interlocking pins (1) on one detachable part (1A) are inserted in to the corresponding holes in the other detachable part (1B). The size of holes and interlocking pins (2) are selected such that the friction between the surfaces of the interlocking pins (2) and holes ensures a tight fit of the interlocking pins (1) in the holes. In this way, two detachable parts (1A) and (1B) of the knitting spool (1) are held together to form a complete spool. FIG. 2 illustrates top and side view of the assembled parts of knitting spool.

According to another embodiment of the invention, the two detachable parts (1A) and (1B) of the knitting loom are held together by O-rings made of rubber or any other suitable elastic material. One or more O-rings may be used for this purpose. To retain the O-rings, the outer surface of the two detachable parts (1A) and (1B) are provided with one or more grooves or recesses. The sizes of the O-rings are selected such that they tightly fit on the two assembled parts (1A) and (1B) of the knitting spool (1).

According to another embodiment of the invention, any other mechanism of attaching the two detachable parts (1A) and (1B) of the knitting spool (1) may be used. For example screws or nut and bolt.

According to another embodiment of the invention, the yarn engaging members of the knitting spool (1) may be detached from the knitting spool (1). For this purpose, number of holes (3) are provided on one end face (4) of the knitting spool (1). The yarn engaging member can be inserted into these holes (3) on one end face (4) of the knitting spool (1). According to one preferred embodiment of the invention, twelve holes are provided on one end face (4) of the knitting spool (1). The Yarn engaging members of different shapes and sizes may be inserted as per the knitting requirements.

FIG. 3 illustrates top and side view of the assembled knitting spool with U-pins according to one embodiment of the present invention. Ends of inverted U pins (5) are inserted into the holes (3) in the end face (4) of the knitting spool (1). The free ends of the U pins (5) may be slanted away from the central axis of the knitting spool (1) to retain yarn during knitting. Two, four or six U pins (5) may be inserted (3) into the holes in the end face (4) of the knitting spool (1) depending on the knitting requirement.

According to one preferred embodiment of the invention, straight pegs (7) with a round head are inserted in to the holes (3) on the end face (4) of the knitting spool (1).

FIG. 4 illustrates top and side view of the assembled knitting spool with pegs according to one embodiment of the present invention. According to yet another embodiment, at least two, four, six, eight, ten or twelve straight pegs (7) may be inserted in to these holes (3).

The choice of straight pegs (7) or U-pins (5) is dependent on the yarn thickness and the article to be wrapped. U-pins (5) are best used with thicker yarns as the created stitch can be bigger and loose.

Figure 5:
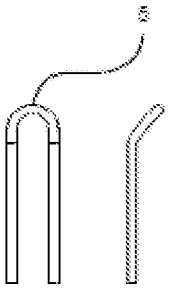
FIG. 5 illustrates front and side view of a U pin which may be assembled on the knitting spool according to one embodiment of the present invention.
Figure 6:
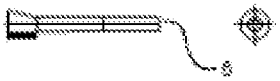
FIG. 6 illustrates side and top view of a peg which may be assembled on the knitting spool according to one embodiment of the present invention.

FIG. 5 and FIG. 6 illustrates front and side view of a U pin (5) and straight pegs (7) which may be assembled on the knitting spool.

The detachable yarn engaging members enable the knitting spool to work with a wide variety of yarns, threads, jewelry wire to create many types of looks and patterns using multiple yarns.

Before knitting a tube around an article which has end attachment bigger than the size of the hole of the knitting spool (1), the two parts of the knitting spool (1) may be detached from each other and the article is placed between the two detachable parts and the parts are assembled such that the article is entrapped in the hole of the assembled knitting spool (1). Now knitting operation is performed to knit a tube around the article. After the knitting operation is finished, the detachable parts (1A) and (1B) of the knitting spool (1) are taken apart to release the article with a tube knitted around it.

The unique ability to split the knitting spool (1) into two halves takes traditional spool knitting to a whole new level of creativity. This unique ability allows for wrapping or knitting around articles with large end attachments like mouse cables, USB cords of smartphones, headphones, handles, removable shoulder straps of bags or totes, etc.

Figure 7:
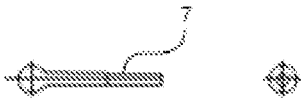
FIG. 7 illustrates side and top view of a starting peg which may be assembled on the knitting spool according to one embodiment of the present invention.

According to another preferred embodiment of the invention, the shape of one peg may be made different than that of the other pegs such that starting point is easily identifiable. FIG. 7 illustrates side and top view of a starting peg which may be assembled on the knitting spool. During knitting a pattern using yarns of different colors, the knitting is started by looping the yarn around this peg (6) so that the starting point is always identifiable.

Various modifications to these embodiments are apparent to those skilled in the art from the description and drawings herein. The principles associated with the various embodiment defined herein may be applied to other embodiments. Therefore, the description is not intended to be limited to the embodiments shown along with the accompanying drawings but is to be provided broadest scope consistent with the principles and novel and inventive features describe/disclosed or suggested herein. Any modifications, equivalent substitutions, improvements etc. within the spirit and principle of the present invention shall all be included in the scope of protection of the present invention.

The invention claimed is:

1. A knitting spool for knitting comprising:

a tubular body having a through hole; and a plurality of yarn retention members mounted at an end face of the tubular body;

wherein the tubular body is formed of two parts detachable along a plane parallel to the longitudinal axis of the tubular body; and wherein the detachable parts are held together by rubber rings.

2. A knitting spool as claimed in claim 1, wherein the tubular body is divided into two equal halves by a plane parallel to the longitudinal axis of the tubular body.

3. A knitting spool as claimed in claim 1, wherein the detachable parts are arranged together by interlocking pin arrangement.

4. A knitting spool as claimed in claim 1, wherein the detachable parts have grooves on the outside surface for accommodating said rubber rings.

5. A knitting spool as claimed in claim 1, wherein the yarn retention members are pegs.

6. A knitting spool as claimed in claim 5, wherein the pegs have a head at free end.

7. A knitting spool as claimed in claim 1, wherein the yarn retention members are U-pins.

8. A knitting spool as claimed in claim 7, wherein the U-pins are inclined outwards from a spool axis at a free end.

9. A knitting spool as claimed in claim 7, wherein each U-pin is mounted in an inverted position on the face of the tubular body.

10. A knitting spool as claimed in claim 5, wherein the pegs are detachable from the tubular body.

11. A knitting spool as claimed in claim 5, wherein the number of pegs arranged on an end face of the tubular body is four, six, eight or twelve.

12. A knitting spool as claimed in claim 7, wherein the number of U-pins arranged on an end face of the tubular body is four or six.

13. A knitting spool as claimed in claim 5, wherein one peg has a different shape than that of other pegs for identifying the starting point during knitting.

14. A knitting spool as claimed in claim 7, wherein the U-pins are detachable from the tubular body.

* * * * *